US009064456B2

(12) United States Patent
Seo et al.

(10) Patent No.: US 9,064,456 B2
(45) Date of Patent: Jun. 23, 2015

(54) ORGANIC LIGHT EMITTING DIODE DISPLAY HAVING SHORT DETECTING CIRCUIT AND METHOD OF DRIVING THE SAME

(75) Inventors: Jeong-Min Seo, Yongin (KR); Sung-Cheon Park, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 234 days.

(21) Appl. No.: 13/419,308

(22) Filed: Mar. 13, 2012

(65) Prior Publication Data

US 2012/0256897 A1 Oct. 11, 2012

(30) Foreign Application Priority Data

Apr. 8, 2011 (KR) ..... 10-2011-0032871

(51) Int. Cl.

| | |
|---|---|
| ***G09G 5/00*** | (2006.01) |
| ***G09G 3/32*** | (2006.01) |
| ***G09G 3/00*** | (2006.01) |
| ***G09G 3/20*** | (2006.01) |

(52) U.S. Cl.

CPC ..... *G09G 3/3233* (2013.01); *G09G 3/006* (2013.01); *G09G 3/20* (2013.01); *G09G 2330/026* (2013.01); *G09G 2330/04* (2013.01)

(58) Field of Classification Search

None

See application file for complete search history.

(56) References Cited

U.S. PATENT DOCUMENTS

| | | | | |
|---|---|---|---|---|
| 2008/0246697 | A1* | 10/2008 | Kim | 345/76 |
| 2011/0273422 | A1* | 11/2011 | Park | 345/211 |
| 2011/0279128 | A1* | 11/2011 | Von Staudt | 324/538 |
| 2012/0050249 | A1* | 3/2012 | Jin et al. | 345/212 |
| 2012/0074868 | A1* | 3/2012 | Tseng et al. | 315/294 |

FOREIGN PATENT DOCUMENTS

| | | | |
|---|---|---|---|
| KR | 10-1999-0009522 | A | 2/1999 |
| KR | 10-0638714 | B1 | 10/2006 |
| KR | 10-2008-0095078 | A | 10/2008 |

* cited by examiner

*Primary Examiner* — Adam R Giesy
*Assistant Examiner* — Henok Heyi
(74) *Attorney, Agent, or Firm* — Knobbe, Martens, Olson & Bear, LLP

(57) ABSTRACT

An organic light emitting diode display including a short detecting circuit and a method of driving the same are disclosed. The organic light emitting diode display includes a pixel unit including pixels coupled to scan lines and data lines, a DC-DC converter for outputting a first power source and a second power source when a start signal is supplied, a first power source line and a second power source line for supplying the first power source and the second power source output from the DC-DC converter to the pixel unit, and a short detecting circuit for determining whether the first power source line and the second power source line are shorted before the DC-DC converter is driven and for supplying the start signal to the DC-DC converter when the first power source line and the second power source line are not shorted.

17 Claims, 3 Drawing Sheets

ORGANIC LIGHT EMITTING DIODE DISPLAY HAVING SHORT DETECTING CIRCUIT AND METHOD OF DRIVING THE SAME

CROSS-REFERENCE TO RELATED APPLICATION

This application claims priority to and the benefit of Korean Patent Application No. 10-2011-0032871, filed on Apr. 8, 2011, in the Korean Intellectual Property Office, the entire content of which is incorporated herein by reference.

BACKGROUND

1. Field

The disclosed technology relates to an organic light emitting diode display having a short detecting circuit and a method of driving the same, and more particularly, to an organic light emitting diode display having a short detecting circuit capable of detecting whether power source lines are shorted before a DC-DC converter is driven to prevent the power source lines from being damaged by the short and a method of driving the same.

2. Description of the Related Technology

Recently, various flat panel displays having reduce weight and volume as compared to cathode ray tubes (CRT) have been developed. Flat panel technologies include liquid crystal displays (LCD), field emission displays (FED), plasma display panels (PDP), and organic light emitting diode (OLED) displays. The organic light emitting diode displays display images using organic light emitting diodes that generate light by re-combination of electrons and holes. The organic light emitting diode display has high response speed and is driven with low power consumption.

In general, an OLED display may be a passive matrix type OLED display (PMOLED) or an active matrix type OLED display (AMOLED) according to a method of driving the OLED display. The AMOLED includes a plurality of gate lines, a plurality of data lines, a plurality of power source lines, and a plurality of pixels coupled to the above lines and arranged in the form of a matrix. In such an organic light emitting diode display, a DC-DC converter for generating power voltages required for driving the pixels by increasing or reducing the voltage of an external power source is provided. The DC-DC converter supplies the generated power voltages to the pixels that display an image through power source lines. However, the power source lines may be shorted due to defect during manufacturing or breakdown during use. In the case where short is generated, when the DC-DC converter is driven, additional damage such as pixel defect may be generated.

SUMMARY OF CERTAIN INVENTIVE ASPECTS

One inventive aspect is an organic light emitting diode display having a short detecting circuit. The display includes a pixel unit with pixels coupled to scan lines and data lines, and a DC-DC converter for outputting a first power voltage and a second power voltage in response to a start signal. The display also includes a first power source line and a second power source line for supplying the first power voltage and the second power voltage from the DC-DC converter to the pixel unit, and a short detecting circuit for determining whether the first power source line and the second power source line are shorted. The short detecting circuit is configured to supply the start signal to the DC-DC converter if the first power source line and the second power source line are not shorted.

Another inventive aspect is a method of driving an organic light emitting diode display. The method includes applying a sensing voltage to a first power source line, detecting a voltage of a second power source line to compare the voltage of the second power source line with a reference voltage, and supplying a start signal to a DC-DC converter if the voltage of the second power source line is less than the reference voltage.

Another inventive aspect is an organic light emitting diode display having a short detecting circuit. The display includes a pixel unit including pixels coupled to scan lines and data lines, and a DC-DC converter for conditionally outputting a first and second power voltages to first and second power source lines. The first and second power source lines respectively supply the first and second power voltages to the pixel unit. The display also includes a short detecting circuit for determining whether the first power source line and the second power source line are shorted, and the short detecting circuit is configured to supply a signal to the DC-DC converter indicating whether the first and second power source lines are shorted, and the DC-DC converter is configured to output the first and second power voltages if the first and second power source lines are not shorted.

BRIEF DESCRIPTION OF THE DRAWINGS

The accompanying drawings, together with the specification, illustrate exemplary embodiments, and, together with the description, serve to explain various features, principles and aspects.

DETAILED DESCRIPTION OF CERTAIN INVENTIVE EMBODIMENTS

Figure 1:
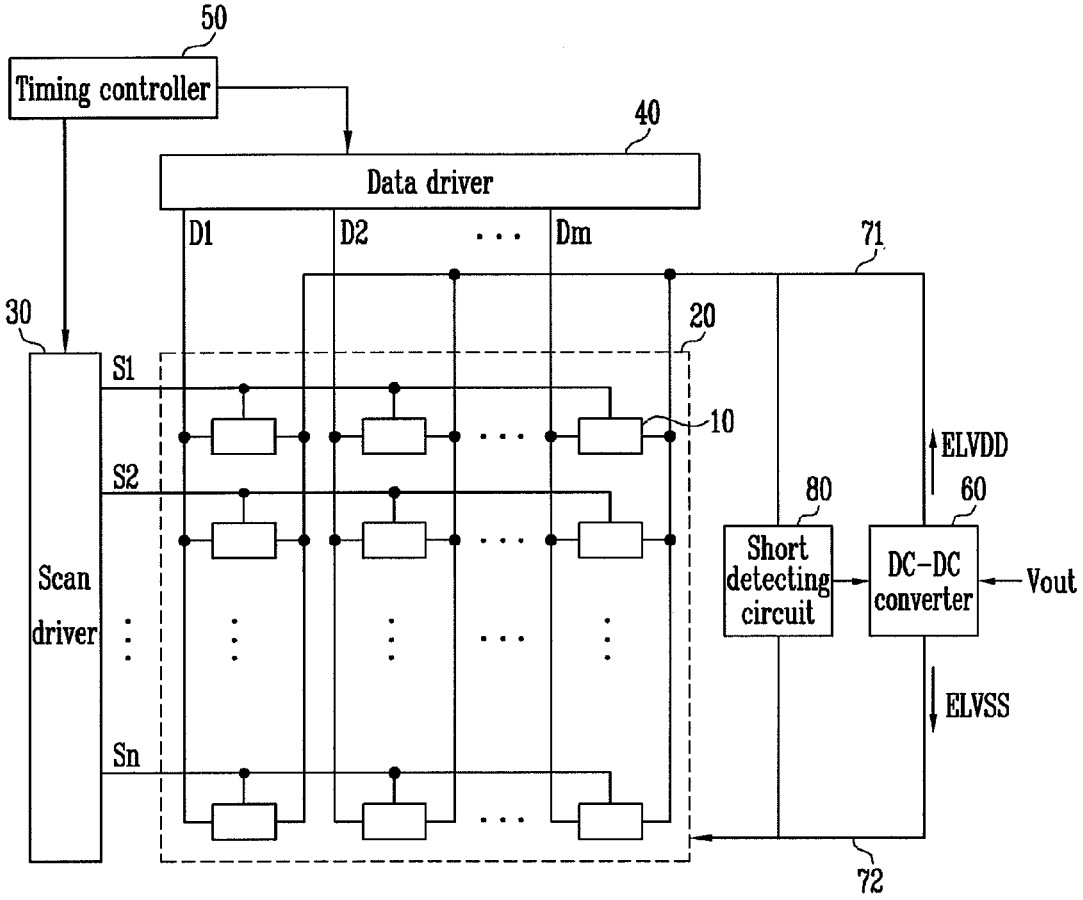
FIG. 1 is a schematic view illustrating an organic light emitting diode display including a short detecting circuit according to an embodiment.

Hereinafter, certain exemplary embodiments are described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals generally refer to like elements throughout.

The advantages and characteristics of the various aspects and a method of achieving the advantages and characteristics are described more fully with reference to the accompanying drawings, in which exemplary embodiments are shown. Embodiments may, however, be practiced in many different forms and should not be construed as being limited to the embodiments set forth herein. In the drawings, when a part is coupled to another part, the part may be directly coupled to another part and the part may be electrically coupled to another part with another element interposed. In the drawings, a part that is not related to a described aspect may be omitted for clarity of description. The same reference numerals in different drawings generally represent the same element, and thus their description may be omitted.

FIG. 1 is a schematic view illustrating an organic light emitting diode display having a short detecting circuit according to an embodiment. Referring to FIG. 1, the organic light emitting diode display having the short detecting circuit includes a pixel unit 20 including pixels 10 coupled to scan lines S1 to Sn and data lines D1 to Dm, a scan driver 30 for supplying scan signals to the pixels 10 through the scan lines S1 to Sn, a data driver 40 for supplying data signals to the pixels 10 through the data lines D1 to Dm, a DC-DC converter 60 for applying a first power source ELVDD and a second power source ELVSS to the pixels 10, and a short detecting circuit 80 for detecting whether a first power source line 71 and a second power source line 72 are shorted and may further include a timing controller 50 for controlling the scan driver 30 and the data driver 40.

The pixels 10 are coupled to the first power source line 71 and the second power source line 72. The pixels 10 that received the first power source ELVDD and the second power source ELVSS from the power source lines 71 and 72 generate an image corresponding to the data signals by the currents that flow from the first power source ELVDD to the second power source ELVSS through organic light emitting diodes (OLED).

The scan driver 30 generates the scan signals according to the control of the timing controller 50 and supplies the generated scan signals to the scan lines S1 to Sn. The data driver 40 generates the data signals according to the control of the timing controller 50 and supplies the generated data signal to the data lines D1 to Dm.

When the scan signals are sequentially supplied to the scan lines S1 to Sn, the pixels 10 are sequentially selected and the selected pixels 10 receive the data signals transmitted from the data lines D1 to Dm.

Figure 2:
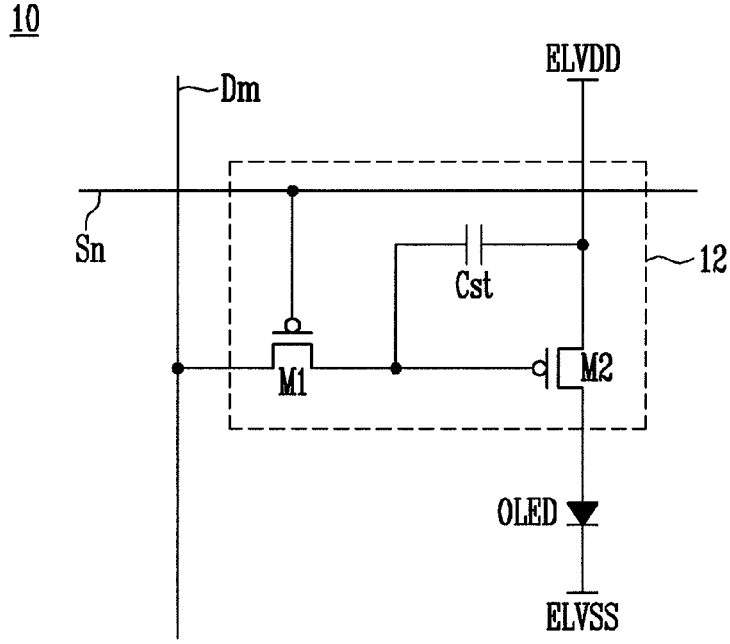
FIG. 2 is a schematic view illustrating the pixel of FIG. 1.

FIG. 2 is a schematic view illustrating an embodiment of the pixel of FIG. 1. In particular, in FIG. 2, for convenience sake, the pixel coupled to the nth scan line Sn and the mth data line Dm is illustrated.

Referring to FIG. 2, the pixel 10 includes an OLED (organic light emitting diode) and a pixel circuit 12 coupled to the data line Dm and the scan line Sn to control the OLED. The anode electrode of the OLED is coupled to the pixel circuit 12 and the cathode electrode of the OLED is coupled to the second power source ELVSS. The OLED generates light with brightness corresponding to the current supplied by the pixel circuit 12.

The pixel circuit 12 controls the amount of current supplied to the OLED to correspond to the data signal supplied to the data line Dm when a scan signal is supplied to the scan line Sn. Therefore, the pixel circuit 12 includes a second transistor M2 coupled between the first power source ELVDD and the OLED, a first transistor M1 coupled to the second transistor M2, the data line Dm, and the scan line Sn, and a storage capacitor Cst coupled between the gate electrode of the second transistor M2 and the first electrode of the second transistor M2.

The gate electrode of the first transistor M1 is coupled to the scan line Sn and the first electrode of the first transistor M1 is coupled to the data line Dm. The second electrode of the first transistor M1 is coupled to one terminal of the storage capacitor Cst. The first electrode of the first transistor M1 is one of a source electrode and a drain electrode and the second electrode of the first transistor M1 is the other electrode from the first electrode of the first transistor M1. For example, when the first electrode is the source electrode the second electrode is the drain electrode.

The first transistor M1 is coupled to the scan line Sn and the data line Dm, and is turned on when the scan signal is supplied from the scan line Sn to supply the data signal from the data line Dm to the storage capacitor Cst. The storage capacitor Cst charges the voltage corresponding to the data signal.

The gate electrode of the second transistor M2 is coupled to one terminal of the storage capacitor Cst and the first electrode of the second transistor M2 is coupled to the other terminal of the storage capacitor Cst and the first power source ELVDD. The second electrode of the second transistor M2 is coupled to the anode electrode of the OLED.

The second transistor M2 controls the amount of current that flows from the first power source ELVDD to the second power source ELVSS through the OLED to correspond to the voltage value stored in the storage capacitor Cst. In response, the OLED generates light corresponding to the amount of current supplied from the second transistor M2.

Since the above-described structure of the pixel of FIG. 2 is only an exemplary embodiment, the pixel 10 of the present invention is not limited to the above structure.

The DC-DC converter 60 receives an external power voltage Vout and converts the supplied external power voltage Vout to generate the first power voltage ELVDD and the second power voltage ELVSS supplied to the pixels 10. The first power voltage ELVDD may have a higher voltage than the second power voltage ELVSS.

For example, the external power voltage Vout may be boosted by the boosting circuit included in the DC-DC converter 60 to generate the first power voltage ELVDD and the external power voltage Vout is boosted by a bucking circuit included in the DC-DC converter 60 to generate the second power voltage ELVSS. The DC-DC converter 60 supplies the generated first and second power voltages ELVDD and ELVSS to the pixel unit 20 through the first power source line 71 and the second power source line 72.

In addition, when the DC-DC converter 60 is in an off state when the DC-DC converter 60 is not driven, the first power voltage ELVDD and the second power voltage ELVSS are not output to the power source lines 71 and 72. The off state may be maintained while an off signal Toff is supplied from the short detecting circuit 80. When a start signal Ton is supplied from the short detecting circuit 80, the DC-DC converter 60 starts to be driven and operates in an on state to output the first power voltage ELVDD and the second power voltage ELVSS.

The short detecting circuit 80 determines whether the first power source line 71 and the second power source line 72 are shorted before the DC-DC converter 60 is driven and supplies the start signal Ton to the DC-DC converter 60 only if the first power source line 71 and the second power source line 72 are not shorted.

Therefore, it is detected whether the first power source line 71 and the second power source line 72 are shorted before the DC-DC converter 60 is driven. When a short is detected, the driving of the DC-DC converter 60 is not started so that damage caused by the short may be minimized.

In addition, in FIG. 1, the short detecting circuit 80 is illustrated as being separated from the scan driver 30 and the data driver 40, however, the short detecting circuit 80 may be integrated with the drivers 30 and 40.

Figure 3:
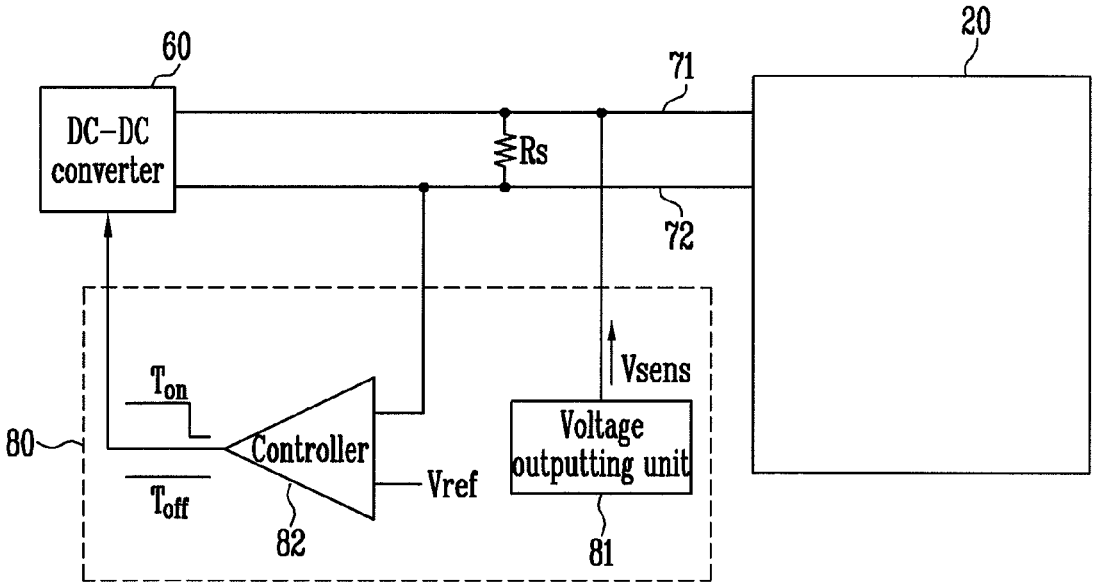
FIG. 3 is a schematic view illustrating the short detecting circuit of FIG. 1.

FIG. 3 is a schematic view illustrating the short detecting circuit illustrated in FIG. 1. Referring to FIG. 3, the short detecting circuit 80 according to an embodiment includes a voltage outputting unit 81 and a controller 82.

The voltage outputting unit 81 applies a sensing voltage Vsens to the first power source line 71. That is, since the DC-DC converter 60 is not yet driven so that the first power voltage ELVDD is not applied to the first power source line 71, the sensing voltage Vsens that is a test voltage is applied.

Therefore, if a short exists between the first power source line 71 and the second power source line 72, current flows from the first power source 71 to the second power source line 72 through short resistance Rs so that a voltage is generated in the second power source line 72. In some circumstances, the voltage detected by the second power source line 72 may be less than the sensing voltage Vsens due to the short resistance Rs.

The controller 82 detects the voltage of the second power source line 72 to compare the detected voltage with a reference voltage Vref and determines that a short is not generated if the detected voltage of the second power source line 72 is less than the reference voltage Vref and a short is generated if the detected voltage of the second power source line 72 is greater than the reference voltage Vref.

Therefore, the start signal Ton is supplied to the DC-DC converter 60 if it is determined that the first power source line 71 and the second power source line 72 are not shorted and the off signal Toff is supplied to the DC-DC converter 60 if it is determined that the first power source line 71 and the second power source line 72 are shorted.

The sensing voltage Vsens may be the same voltage as the first power voltage ELVDD, however, the voltage value of the sensing voltage Vsens may be different from the voltage value of the first power voltage ELVDD. In addition, the reference voltage Vref as a reference value for determining whether the short exists may be determined in consideration of the short resistance Rs and may vary in accordance with the characteristic of the organic light emitting diode display.

In addition, as an example, the start signal Ton is illustrated as a voltage in a high level and the off signal Toff is illustrated as a voltage in a low level. However, the present invention is not limited to the above.

Figure 4:
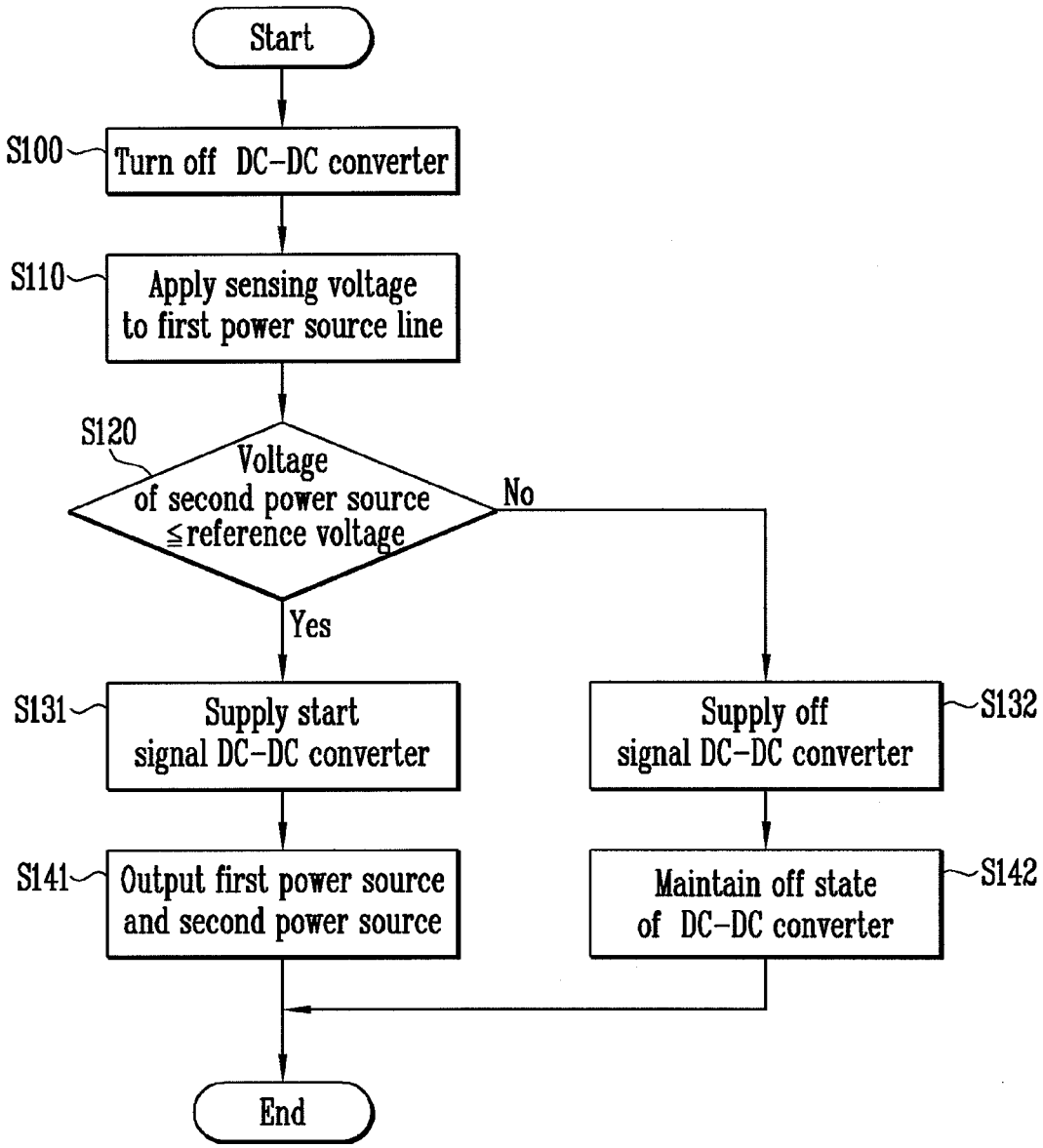
FIG. 4 is a flowchart illustrating a method of driving an organic light emitting diode display according to an embodiment.

FIG. 4 is a flowchart illustrating a method of driving the organic light emitting diode display according to an embodiment.

First, the DC-DC converter 60 before being driven maintains an off state (S100). The voltage outputting unit 81 of the short detecting circuit 80 applies the sensing voltage Vsens to the first power source line 71 (S110). Then, the controller 82 of the short detecting circuit 80 detects the voltage of the second power source line 72 to compare the detected voltage with the reference voltage Vref (S120).

If the detected voltage of the second power source line 72 is less than or equal to the reference voltage Vref, the start signal Ton is supplied to the DC-DC converter 60 (S131). Once the DC-DC converter 60 receives the start signal Ton, the DC-DC converter 60 outputs the first power voltage ELVDD and the second power voltage ELVSS to the power source lines 71 and 72 and to supply the first power voltage ELVDD and the second power voltage ELVSS to the pixel unit 20 (S141).

However, if the detected voltage of the second power source line 72 is greater than the reference voltage Vref, the off signal Toff is supplied to the DC-DC converter 60 (S132). Once the DC-DC converter 60 receives the off signal Toff, the DC-DC converter 60 maintains an off state and does not output the first power voltage ELVDD and the second power voltage ELVSS.

While various features and aspects have been described in connection with certain exemplary embodiments, it is to be understood that the invention is not limited to the disclosed embodiments, but, on the contrary, is intended to cover various modifications and equivalent arrangements.

What is claimed is:

1. An organic light emitting diode display having a short detecting circuit, the display comprising:

a pixel unit including pixels coupled to scan lines and data lines;

a DC-DC converter configured to output a first power voltage and a second power voltage in response to a start signal;

a first power source line and a second power source line configured to supply the first power voltage and the second power voltage from the DC-DC converter to the pixel unit; and a short detecting circuit configured to determine whether the first power source line and the second power source line are shorted, wherein the short detecting circuit is configured to supply the start signal to the DC-DC converter if the first power source line and the second power source line are not shorted, wherein the short detecting circuit includes:

a voltage outputting unit configured to apply a sensing voltage to the first power source line, and a controller configured to compare a voltage of the second power source line with a reference voltage and to supply the start signal to the DC-DC converter if the voltage of the second power source line is less than the reference voltage.

2. The organic light emitting diode display as claimed in claim 1, wherein the pixels included in the pixel unit receive the first power voltage and the second power voltage.

3. The organic light emitting diode display as claimed in claim 1, wherein the first power voltage has a higher voltage than the second power voltage.

4. The organic light emitting diode display as claimed in claim 1, further comprising:

a scan driver for supplying scan signals to the pixels through the scan lines; and a data driver for supplying data signals to the pixels through the data lines.

5. The organic light emitting diode display as claimed in claim 4, wherein the short detecting circuit is included in the scan driver or the data driver.

6. The organic light emitting diode display as claimed in claim 1, wherein the DC-DC converter is turned on if the start signal is supplied in a low state.

7. A method of driving an organic light emitting diode display, comprising:

applying a sensing voltage to a first power source line;

detecting a voltage of a second power source line to compare the voltage of the second power source line with a reference voltage; and supplying a start signal to a DC-DC converter if the voltage of the second power source line is less than the reference voltage.

8. The method as claimed in claim 7, further comprising:

the DC-DC converter outputting a first power voltage and a second power voltage to a first power source line and a second power source line, respectively.

9. The method as claimed in claim 8, further comprising supplying the first power voltage and the second power voltage to pixels included in a pixel unit through the first power source line and the second power source line.

10. The method as claimed in claim 9, wherein the first power voltage has a higher value than the second power voltage.

11. The method as claimed in claim 8, wherein the DC-DC converter is turned on if the start signal is supplied in a low state.

12. An organic light emitting diode display having a short detecting circuit, the display comprising:

a pixel unit including pixels coupled to scan lines and data lines;

a DC-DC converter for conditionally outputting a first and second power voltages to first and second power source lines, the first and second power source lines respectively supplying the first and second power voltages to the pixel unit; and a short detecting circuit for determining whether the first power source line and the second power source line are shorted, wherein the short detecting circuit is configured to supply a signal to the DC-DC converter indicating whether the first and second power source lines are shorted, wherein the DC-DC converter is configured to output the first and second power voltages if the first and second power source lines are not shorted, wherein the short detecting circuit includes:

a voltage outputting unit configured to apply a sensing voltage to the first power source line, and a controller configured to compare a voltage of the second power source line with a reference voltage and to supply the signal to the DC-DC converter based on the comparison.

13. The organic light emitting diode display as claimed in claim 12, wherein the pixels included in the pixel unit receive the first power voltage and the second power voltage.

14. The organic light emitting diode display as claimed in claim 12, wherein the first power voltage has a higher voltage than the second power voltage.

15. The organic light emitting diode display as claimed in claim 12, further comprising:

a scan driver for supplying scan signals to the pixels through the scan lines; and a data driver for supplying data signals to the pixels through the data lines.

16. The organic light emitting diode display as claimed in claim 15, wherein the short detecting circuit is included in the scan driver or the data driver.

17. The organic light emitting diode display as claimed in claim 12, wherein the DC-DC converter is configured to not output the first and second power voltages if the first and second power source lines are shorted.

* * * * *